US010328958B2

(12) United States Patent
Eckl et al.

(10) Patent No.: US 10,328,958 B2
(45) Date of Patent: Jun. 25, 2019

(54) LIGHT SIGNAL

(71) Applicant: SIEMENS MOBILITY GMBH, Munich (DE)

(72) Inventors: Rolf Eckl, Berlin (DE); Kay Koester, Fredersdorf (DE); Zeljko Marincic, Berlin (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 15/539,293

(22) PCT Filed: Jan. 5, 2016

(86) PCT No.: PCT/EP2016/050084
§ 371 (c)(1),
(2) Date: Jun. 23, 2017

(87) PCT Pub. No.: WO2016/113152
PCT Pub. Date: Jul. 21, 2016

(65) Prior Publication Data

US 2018/0265105 A1 Sep. 20, 2018

(30) Foreign Application Priority Data

Jan. 12, 2015 (DE) ..... 10 2015 200 246

(51) Int. Cl.
*B61L 5/18* (2006.01)
*F21V 9/40* (2018.01)
*G08G 1/095* (2006.01)

(52) U.S. Cl.
CPC ..... *B61L 5/1845* (2013.01); *F21V 9/40* (2018.02); *G08G 1/095* (2013.01); *B61L 2207/02* (2013.01)

(58) Field of Classification Search
CPC ..... B61L 5/1845; B61L 2207/02; F21V 9/40; G08G 1/095
USPC ..... 340/815.41, 506, 3.1
See application file for complete search history.

(56) References Cited

U.S. PATENT DOCUMENTS

| | | | |
|---|---|---|---|
| 4,652,851 | A | 3/1987 | Lewin |
| 5,412,492 | A | 5/1995 | Zammit et al. |
| 6,731,433 | B2 | 5/2004 | Jacobsen et al. |
| 2005/0122719 | A1 | 6/2005 | Liebscher et al. |

FOREIGN PATENT DOCUMENTS

| | | | |
|---|---|---|---|
| CN | 1624376 | A | 6/2005 |
| CN | 1803508 | A | 7/2006 |
| CN | 104949071 | A | 9/2015 |
| DE | 19608886 | C2 | 8/1998 |
| DE | 102013207416 | A1 | 10/2014 |
| EP | 1215640 | A2 | 6/2002 |
| GB | 2497757 | A | 6/2013 |

*Primary Examiner* — Daryl C Pope
(74) *Attorney, Agent, or Firm* — Laurence Greenberg; Werner Stemer; Ralph Locher

(57) ABSTRACT

A light signal, in particular for rail-bound traffic routes, includes a light source, an optical system and a control device for adjusting an emission characteristic. In order to improve the way optical parameters, in particular regarding brightness, phantom light and path geometry can be adjusted, the control device is configured to adjust the transmission properties of at least one smart glass element disposed in the luminous or light flux.

9 Claims, 2 Drawing Sheets

LIGHT SIGNAL

BACKGROUND OF THE INVENTION

Field of the Invention

The invention relates to a light signal, in particular for rail-bound traffic routes, having a light source, an optical system and a control device for adjusting an emission characteristic.

In principle, light signals serve as signal emitters or symbol indicators which impart particular information by means of coloring and/or shaping of a luminous surface, that is, by means of the emission characteristic. This often involves safety-related information which must not be optically falsified or overlaid with extraneous light. The unwanted lighting up or falsification of a light point by the ingress of ambient light, for example sunlight or headlamp light is designated a phantom effect. By means of the phantom effect, in extreme cases, a false indication can occur due to an untimely illumination of a light point or a color shift. This effect is particularly disturbing when LED arrays are used as the light source, since LEDs can be stimulated to luminesce by incident light and in the case of LED light sources, rear reflectors are often used. Apart from the phantom generators which are predictable with projection, for example, a low sun for signals in an east-west orientation, sporadic or unforeseen sources also arise as phantoms, for example, vehicle or building lights, reflection at surfaces, for example, on glazed facades or snow coverings. Thus a signal which is intended to be phantom-proof by virtue of the location can be phantom-prone. In general, the attempt is made to minimize the phantom effect through shades, shields, the avoidance of east-west orientation or by the repetition of critical signals.

The explanations below relate essentially to light signals for representing signal indications for rail-bound traffic routes, but without the claimed subject matter being restricted to this use.

In the case of railway signals, it must be ensured that the traction vehicle driver can always unambiguously recognize the signal intended for him on approaching it. Herein, different route geometries, that is, straight stretches, curves and/or height differences must be taken into account. Apart from the far field representation, a near field representation of the signal indication is also required so that the traction vehicle driver can recognize the light signal even when standing directly in front of the signal. Furthermore, a brightness adjustment to different ambient light conditions, in particular a day/night adjustment, is required.

The light signals for rail-bound traffic routes are subject to strict regulation-related requirements with regard to the permitted brightness limits, the spatial light distribution and the phantom light strength.

FIG. 1 shows schematically the structure of a known light signal.

Herein, a housing 1 is provided, into which an LED light source 2 with secondary optics, for example, light guides or lenses, for light mixing and beam formation, as well as an optical system 3, are installed. The optical system 3 consists substantially of a front lens 4, at least one diffuser panel 5 and a front panel 6, wherein these components can also be configured as a combined part. A control device 7 is connected to a functional light sensor 8 within the housing 1 for detecting the intensity and/or color of the light flux. The control device 7 applies to the LED light source 2 the measurement values of the functional light sensor 8 and target parameters pre-set by a signal tower.

The diffuser panel 5 is preferably provided with a diffuser segment for the signal indication visualization in the near field, wherein a gray coloration of the diffuser panel 5 counteracts the phantom effect. With this uniting of the light scattering and the reduction of the phantom effect, however, a compromise unavoidably arises which leads thereto that the phantom protection effect is not sufficient at least for the group of light signals close to the ground which shine upwardly in the near field. Due to the dependence on scattering parameters pre-set at the signal tower, in order to achieve the optical power data, more gray filters and/or gray colored diffuser panels 5 are often required. The range of the transmissions of gray filters used extends from ca. 3% to over 70% transmittance. The necessary transmittance is created by the choice of the filter material and adjustment of the material thickness. Herein, the gray filter must adhere, apart from the mechanical installation conditions, also to the optical requirements regarding color neutrality and long term stability.

SUMMARY OF THE INVENTION

It is an object of the invention to provide a light signal of the aforementioned type wherein an impairment of the safety, particularly as a result of non-optimum signal brightness, or near field and far field illumination and/or phantom effect and/or curved stretches is largely preventable.

According to the invention, the object is achieved thereby that the control device is formed for transmission adjustment of at least one smart glass element arranged in the light flux.

With smart glass technology, the transmission properties of a panel-shaped element are adjusted by applying an electric voltage, by heat or by incident light. Smart glass is essentially continuously tunable, whereas the common diffuser panels have only discrete transmission values and therefore have a broad application only in combination. Furthermore, the transmission values of the smart glass inserts are not material thickness-dependent. Due to the continual further development of smart glass technology, ever more varied smart glass elements are available ever more economically. The possibility exists in the case of an error or a major phantom effect, to switch the smart glass element of the light signal to opaque or non-transmissive or under altered installation conditions and for day/night switch-over, to realize an adaptation of the light intensity by simple means with an ambient light sensor. Diffuse or scattering properties of the smart glass element can also be adjusted for the purpose of forming the light distribution. The smart glass element can entirely replace diffuser panels and gray filters. The control device usually provided for brightness adjustment of the light source additionally or alternatively serves for controlling the transmission of the smart glass element. In this way, a simple construction of the light signal for different location conditions is provided. The transmission controllability of the smart glass element enables a substantially more exact adjustability of the authorization-related requirements regarding the permitted brightness limits, possibly also with continuous light intensity regulation for day, twilight and night operation, as well as the spatial light distribution and phantom light intensity.

According to another feature of the invention, the smart glass element is provided for brightness adjustment and is arranged in the region of a light output opening. In this way, the brightness control of the light source is dispensed with. The current supply to the light source can be constantly adjusted. With the arrangement of the smart glass element close to the light output opening, a front panel can also be dispensed with.

According to a further feature of the invention, it is provided that the smart glass element comprises a plurality of separate transmission-adjustable smart glass panels. In particular, a blink mode is thus possible with successively alternating control of the individual smart glass panels even if the switching times of individual smart glass panels are per se too high. For the day/night switch-over also, the switching off or switching on of at least one separate transmission-adjustable smart glass panel can be advantageous. It is also possible, however, to realize the coarse adjustment of the daylight intensity and the night light intensity with two-point control of the light source and to realize the fine adjustment by means of transmission setting of the smart glass element.

In addition or alternatively, according to an added feature of the invention, the control device can be connected on the signal input side to at least one ambient light sensor. By taking account of the ambient light for adjusting the transmission values of the smart glass element, for example, a continuous adaptation to daylight, twilight and night vision conditions can be carried out.

Preferably, according to an additional feature of the invention, the control device can be connected on the signal input side to at least one extraneous light sensor to measure phantom light, and on the control output side to the smart glass element. Thus the control device reduces the transmission of the smart glass element in order to reduce the current phantom light ingress and simultaneously increases the useful light intensity. In this way, the phantom light is reduced and nevertheless, a constant signal light intensity is ensured.

According to yet another feature of the invention, the smart glass element is arranged in an aperture segment of the light flux between the light source and the optical system. With this arrangement in conjunction with the positioning of the light source and the optical system, possibly also of mirrors and other components of the light signal, optionally, different beam geometries and thus different light distributions can be realized for the illumination of different track lay-outs.

For this purpose, the smart glass element according to yet a further feature of the invention is preferably equipped with a plurality of separate transmission-adjustable, circular segment-shaped smart glass panel segments. By means of the smart glass panel segments, different influence variables of the illumination can be very easily combined and optimally adjusted. In this way, a very precisely defined light distribution results, which is adjustable to very different track lay-outs. Track layout-specific diffuser panels are no longer required.

The smart glass element can be used for beam shaping. For example, according to concomitant features of the invention, the smart glass element can be arranged so that it protrudes into the light flux. Furthermore, the smart glass element can protrude into a part of the light flux and/or the light signal can have a plurality of smart glass elements which are arranged so that they protrude differently far into the light flux.

BRIEF DESCRIPTION OF THE SEVERAL VIEWS OF THE DRAWING

The invention will now be described in greater detail by reference to the illustrations in the figures. In the drawings.

DESCRIPTION OF THE INVENTION

Figure 1:
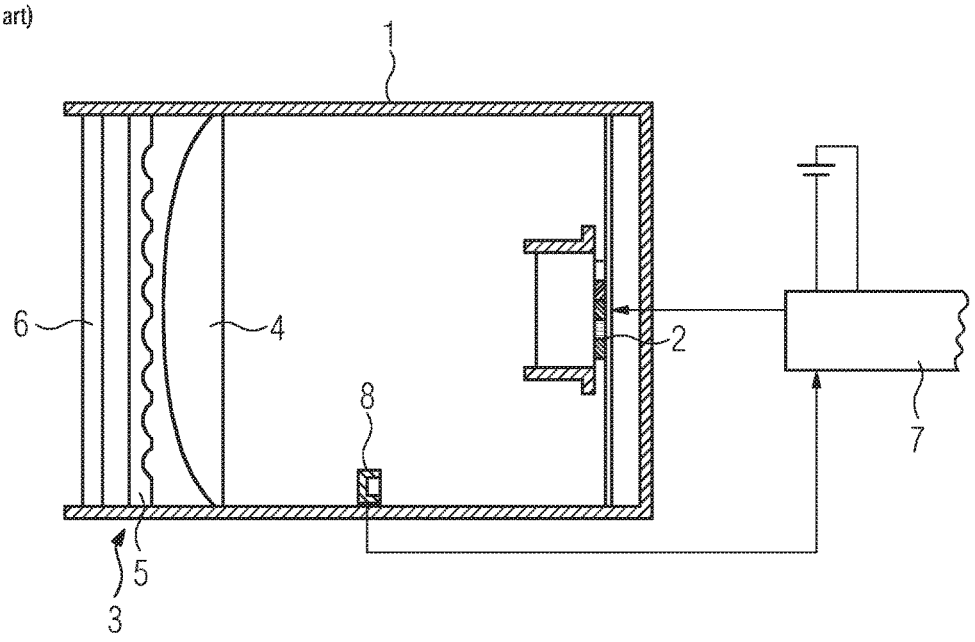
FIG 1 (Prior art)
FIG. 1 is a schematic representation of the light signal of known construction, described above.
Figure 2:
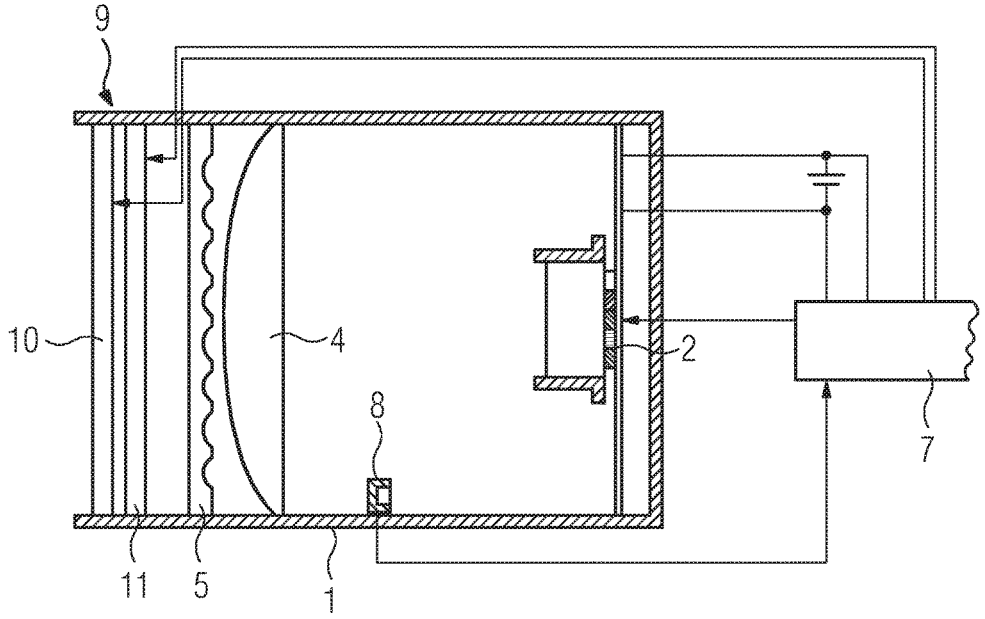
FIGS. 2-4 are three exemplary embodiments of light signals of known construction in the same manner of representation as FIG. 1.

FIG. 2 shows a light signal in which in place of the front panel (6, FIG. 1), a smart glass element (9) is provided. The transmittance of the smart glass element 9 and thus the brightness of the light signal is adjusted with the control device 7. The usual brightness adjustability of the light source 2 according to FIG. 1 is therefore dispensable. In the exemplary embodiment, the smart glass element 9 consists of two separate transmission controllable smart glass panels 10 and 11. By this means, the switchover between day and night operation is simplified. Furthermore, a blink function can also be realized through alternating control of the smart glass panels 10 and 11 when the desired blink frequency is not implementable due to too high a switching time of a single smart glass panel 10 or 11.

Figure 3:
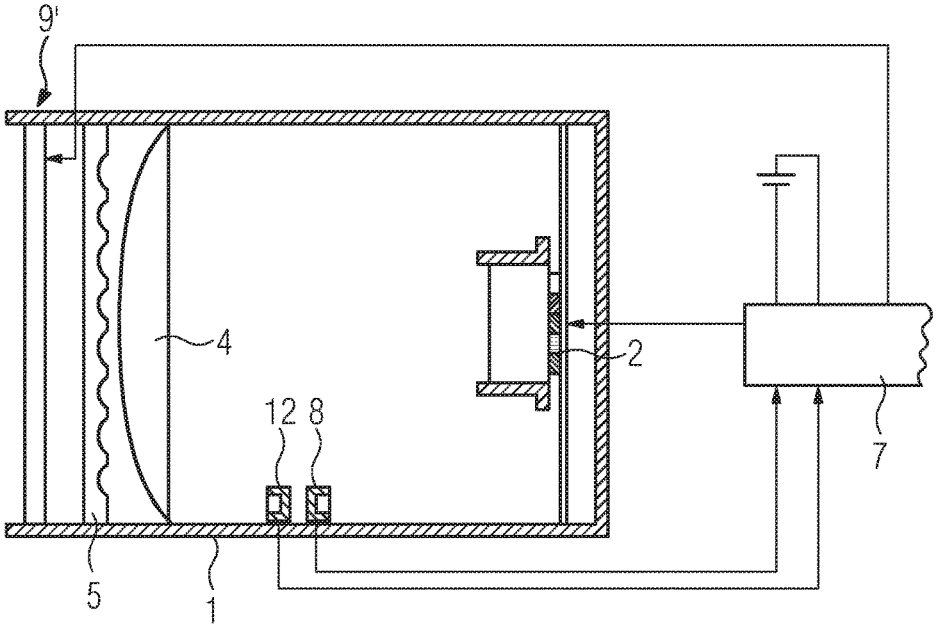

FIG. 3 shows a light signal with phantom light reduction. In place of the front panel (6, FIG. 1), a smart glass element 9', the transmission of which is adjustable by means of the control device 7 dependent upon measurement values of an extraneous light sensor 12, serves this purpose. In order to compensate for the increasing graying-out of the smart glass element 9' with relatively strong phantom effect, the control device 7 simultaneously increases the light intensity of the LED light source 2.

Figure 4:
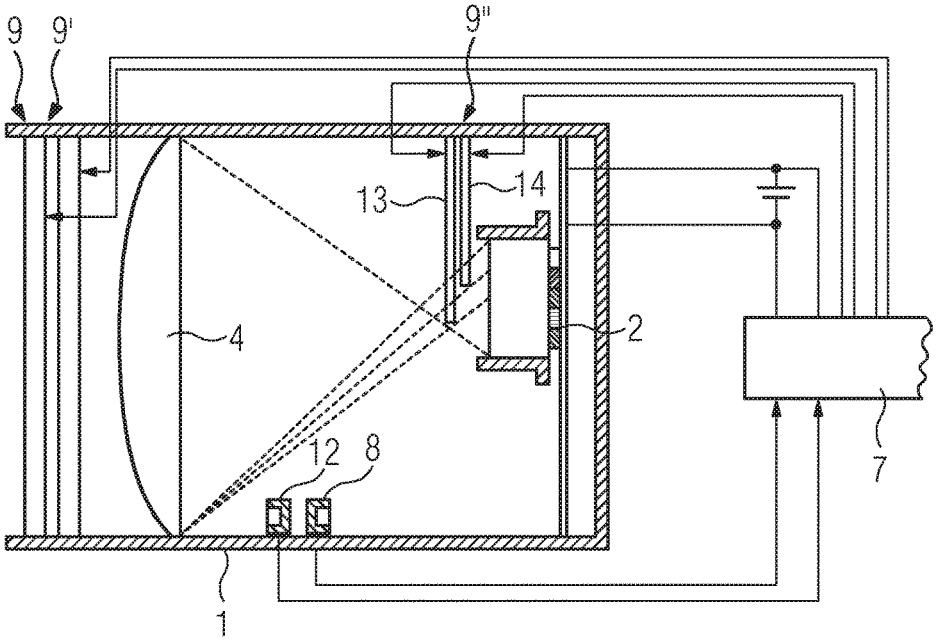

The exemplary embodiment represented in FIG. 4 shows a combination of the brightness regulation according to FIG. 2 with the smart glass element 9 and the phantom light reduction according to FIG. 3 with the smart glass element 9' and a further smart glass element 9" for light flux deflection relative to the optical axis. It is evident that the smart glass element 9" is arranged between the LED light source 2 and the optical system 3. In the exemplary embodiment, the smart glass element 9" consists of two separate smart glass panel segments 13 and 14, which protrude differently far into the light flux. Apart from the control signals for the smart glass elements 9 and 9', the control device 7 also generates the control signals for the transmittance of the smart glass panel segments 13 and 14. The latter control signals can certainly be different in order to adjust the desired spatial light distribution, in particular depending on the respective track geometry.

The invention claimed is:

1. A light signal usable for rail-bound traffic routes, the light signal comprising:

a light source having an emission characteristic and emitting light flux;

an optical system downstream of said light source;

at least one smart glass element disposed in the light flux;

at least one ambient light sensor; and a control device configured for adjusting the emission characteristic of said light source and configured for transmission adjustment of said at least one smart glass element, said control device having a signal input side connected to said at least one ambient light sensor.

2. The light signal according to claim 1, wherein said at least one smart glass element is provided for brightness adjustment and is disposed in a region of a light output opening.

3. The light signal according to claim 1, wherein said at least one smart glass element includes a plurality of separate transmission-adjustable smart glass panels.

4. A light signal usable for rail-bound traffic routes, the light signal comprising:

a light source having an emission characteristic and emitting light flux;

an optical system downstream of said light source;

at least one smart glass element disposed in the light flux;

at least one extraneous light sensor; and a control device configured for adjusting the emission characteristic of said light source and configured for transmission adjustment of said at least one smart glass element;

said control device having a signal input side connected to said at least one extraneous light sensor to measure phantom light; and said control device having a control output side connected to said at least one smart glass element.

5. A light signal usable for rail-bound traffic routes, the light signal comprising:

a light source having an emission characteristic and emitting light flux;

an optical system downstream of said light source;

at least one smart glass element disposed in the light flux, said at least one smart glass element being disposed in an aperture segment of the light flux between said light source and said optical system; and a control device configured for adjusting the emission characteristic of said light source and configured for transmission adjustment of said at least one smart glass element.

6. A light signal usable for rail-bound traffic routes, the light signal comprising:

a light source having an emission characteristic and emitting light flux;

an optical system downstream of said light source;

at least one smart glass element disposed in the light flux, said at least one smart glass element being disposed in an aperture segment of the light flux between said light source and said optical system, and said at least one smart glass element including a plurality of separate transmission-adjustable circular-segment shaped smart glass panel segments; and a control device configured for adjusting the emission characteristic of said light source and configured for transmission adjustment of said at least one smart glass element.

7. The light signal according to claim 1, wherein said at least one smart glass element protrudes into the light flux.

8. The light signal according to claim 7, wherein said at least one smart glass element protrudes into a part of the light flux.

9. The light signal according to claim 1, wherein said at least one smart glass element includes a plurality of smart glass elements protruding over different distances into the light flux.

* * * * *